US007789763B1

(12) United States Patent
Smith

(10) Patent No.: US 7,789,763 B1
(45) Date of Patent: Sep. 7, 2010

(54) GOLF SWING TEACHING AID

(76) Inventor: Richard G. Smith, 308 Lance Way, Birmingham, AL (US) 35206

( * ) Notice: Subject to any disclaimer, the term of this patent is extended or adjusted under 35 U.S.C. 154(b) by 0 days.

(21) Appl. No.: 12/510,654

(22) Filed: Jul. 28, 2009

(51) Int. Cl.
*A63B 69/36* (2006.01)

(52) U.S. Cl. ..... 473/214; 473/212

(58) Field of Classification Search ..... 473/63, 473/212, 213, 214, 266, 276; 602/20, 21, 602/62

See application file for complete search history.

(56) References Cited

U.S. PATENT DOCUMENTS

| | | | | |
|---|---|---|---|---|
| 3,036,831 | A | 5/1962 | Engan | |
| 3,099,448 | A * | 7/1963 | Salvo et al. | 473/63 |
| 3,339,926 | A * | 9/1967 | Coupar | 473/214 |
| 3,606,342 | A | 9/1971 | Albertson, Jr. | |
| 4,017,086 | A | 4/1977 | Washburn | |
| 4,088,318 | A | 5/1978 | Massman | |
| 4,176,840 | A | 12/1979 | Lanning | |
| 4,575,089 | A * | 3/1986 | Corbett et al. | 473/214 |
| D337,180 | S | 7/1993 | Bailey | |
| 5,324,038 | A | 6/1994 | Sasser | |
| 5,401,017 | A * | 3/1995 | McDonald et al. | 473/213 |
| 5,472,206 | A * | 12/1995 | Manley et al. | 473/214 |
| 5,511,788 | A | 4/1996 | Manley et al. | |
| 5,797,803 | A | 8/1998 | Jung | |
| 6,656,056 | B1 | 12/2003 | Leonard | |
| 2008/0026863 | A1 * | 1/2008 | Eck | 473/212 |

* cited by examiner

*Primary Examiner*—Nini Legesse

(57) ABSTRACT

A golf swing teaching aid includes an arm cuff positionable on an upper portion of a golfer's forward arm. A hand engaging member is positionable on a hand of the forward arm and has a first side, a second side, a forward edge, a rear edge, a first lateral edge and a second lateral edge. A plurality of couplers engages and urges toward each other the first and second lateral edges. An elongated rod has a cuff end and a hand end. The cuff end is pivotally coupled to the arm cuff. The hand end is pivotally coupled to the first side of the hand engaging member. The rod is straight and maintains a distance between the arm cuff and the hand engaging member. The hand engaging member and the arm cuff are positionable on the forward arm to resist bending of the forward arm during a golf swing.

11 Claims, 6 Drawing Sheets

GOLF SWING TEACHING AID

BACKGROUND OF THE DISCLOSURE

Field of the Disclosure

The disclosure relates to golf swing teaching devices and more particularly pertains to a new golf swing teaching device for retaining a person's arm in a substantially straight orientation while making a golf swing.

SUMMARY OF THE DISCLOSURE

An embodiment of the disclosure meets the needs presented above by generally comprising an arm cuff that is positionable on an upper portion of a golfer's forward arm. A hand engaging member is positionable on a hand of the forward arm and has a first side, a second side, a forward edge, a rear edge, a first lateral edge and a second lateral edge. A plurality of couplers engages and urges toward each other the first and second lateral edges. An elongated rod has a cuff end and a hand end. The cuff end is pivotally coupled to the arm cuff. The hand end is pivotally coupled to the first side of the hand engaging member. The rod is straight and maintains a distance between the arm cuff and the hand engaging member. The hand engaging member and the arm cuff are positionable on the forward arm to resist bending of the forward arm during a golf swing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
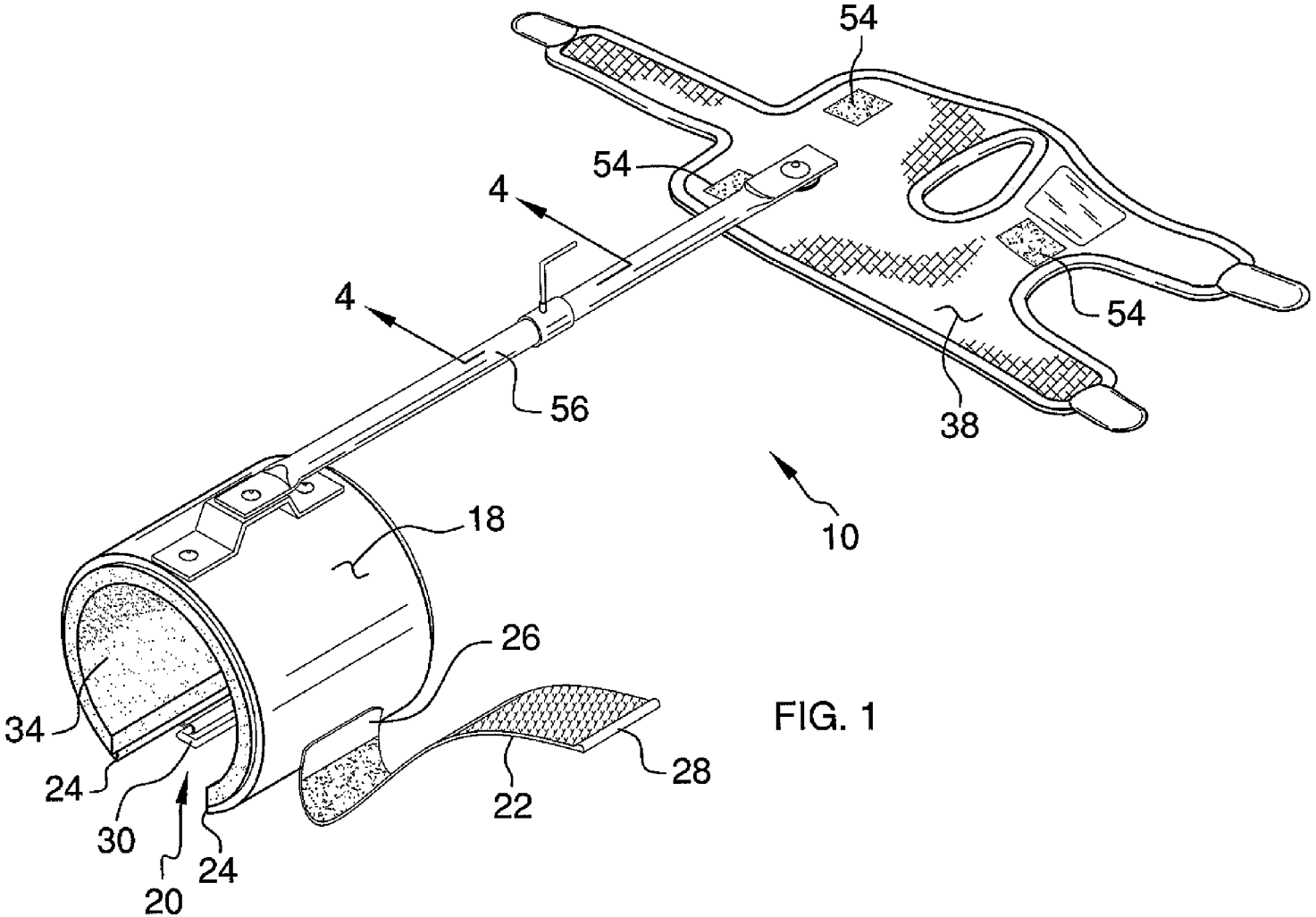
FIG. 1 is a top perspective view of a golf swing teaching aid according to an embodiment of the disclosure.
Figure 2:
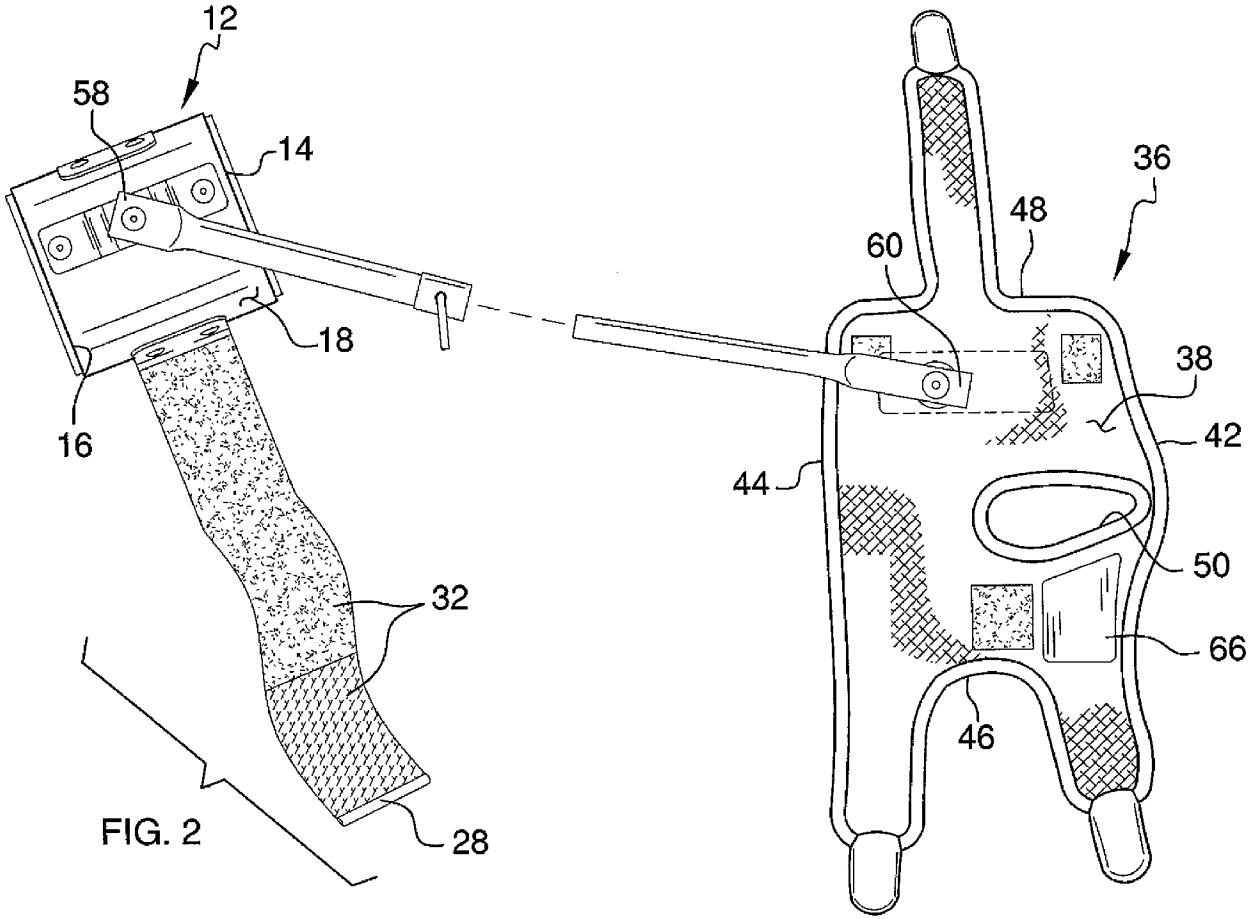
FIG. 2 is a top expanded view of an embodiment of the disclosure.
Figure 2A:
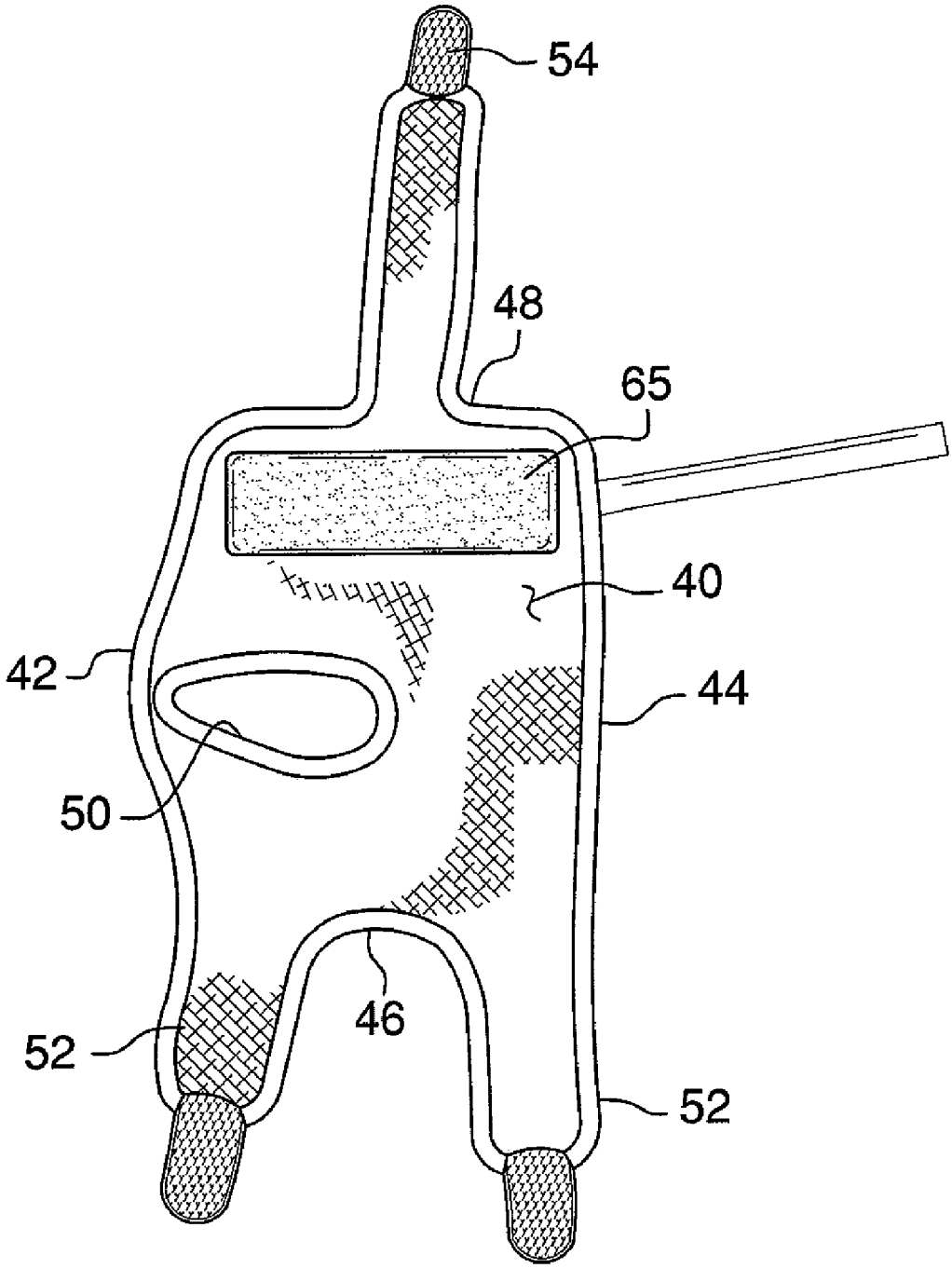
FIG. 2A is a bottom view of a hand engagement member of an embodiment of the disclosure.
Figure 3:
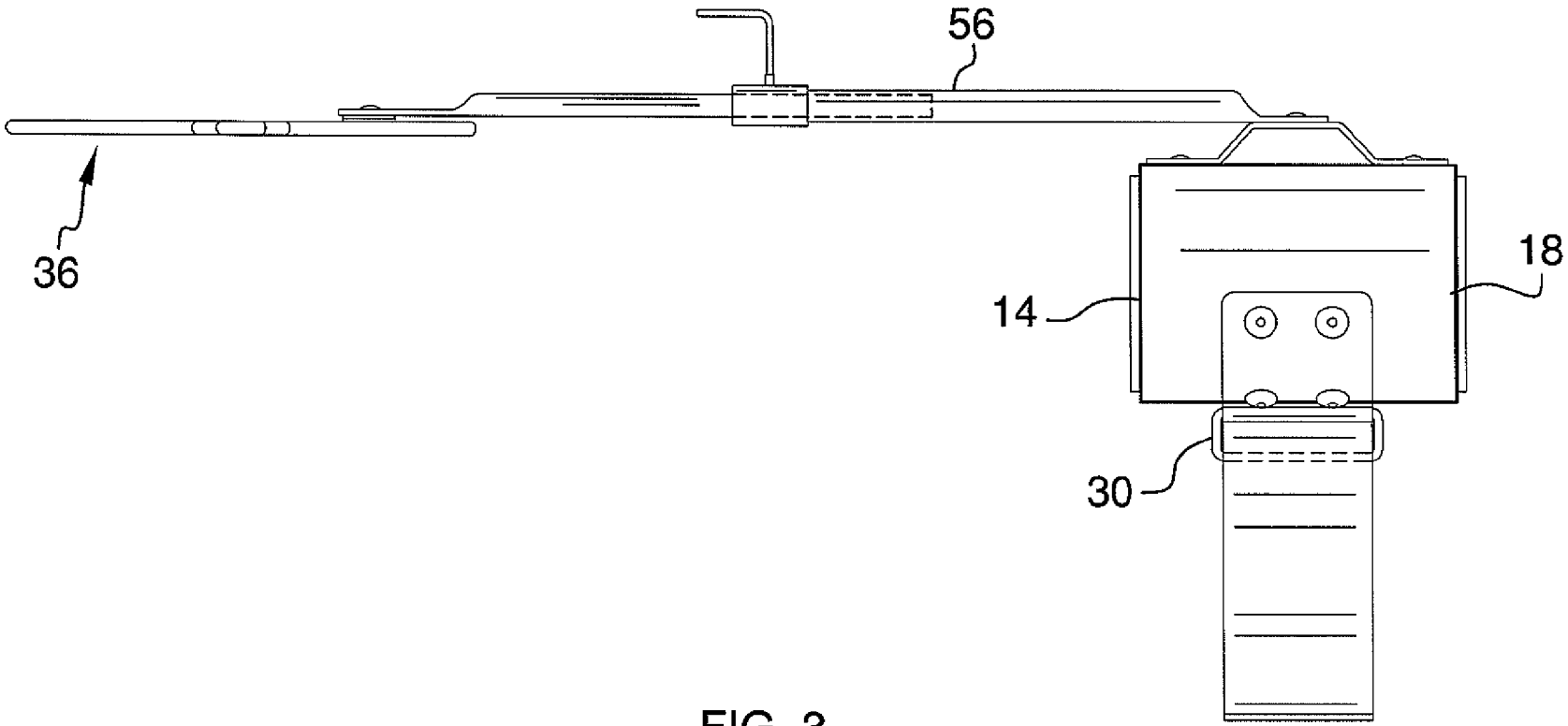
FIG. 3 is a side view of an embodiment of the disclosure.
Figure 4:
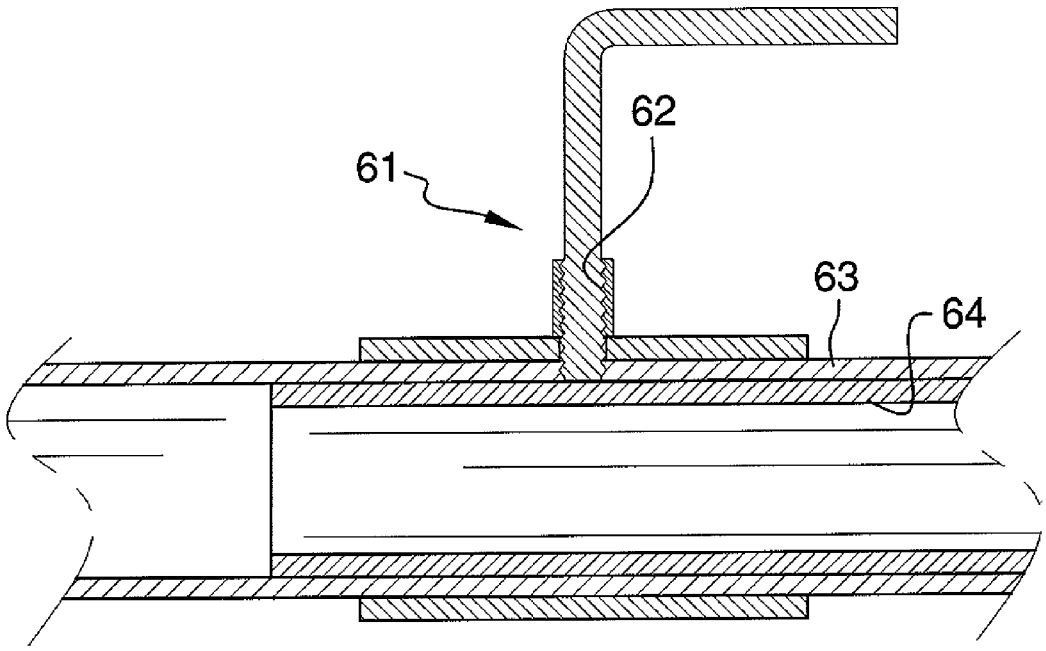
FIG. 4 is a cross sectional view taken along line 4-4 of FIG. 1 of an embodiment of the disclosure.
Figure 5:
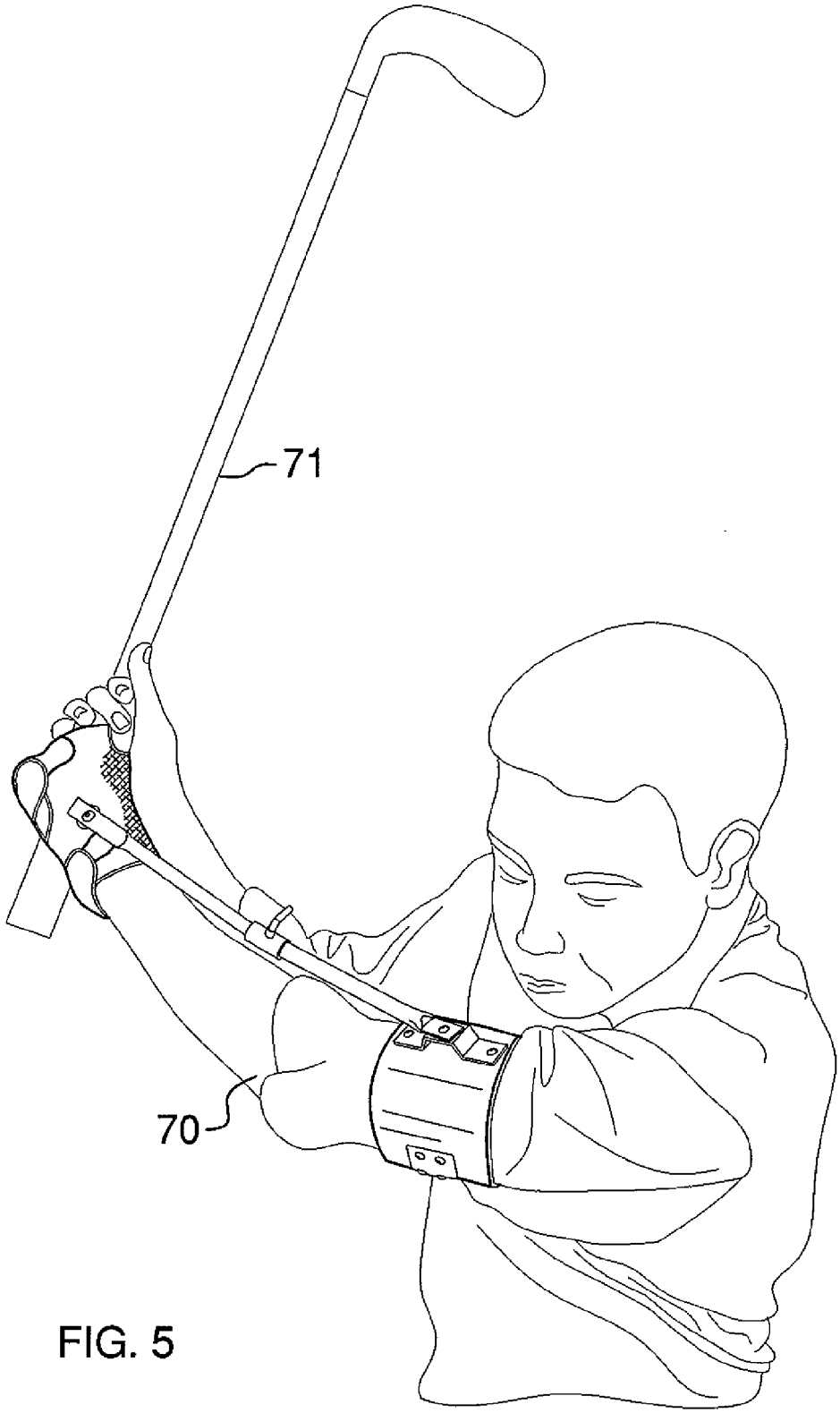
FIG. 5 is a perspective in-use view of an embodiment of the disclosure.

With reference now to the drawings, and in particular to FIGS. 1 through 5 thereof, a new golf swing teaching device embodying the principles and concepts of an embodiment of the disclosure and generally designated by the reference numeral 10 will be described.

As best illustrated in FIGS. 1 through 5, the golf swing teaching aid 10 generally comprises an arm cuff 12 that is positionable on an upper portion of a golfer's forward arm 70. The forward arm 70 is being defined as the arm which the golfer leads with while swinging a golf club 71. For a right handed golfer this would be the left arm and for a left handed golfer this would be the right arm. The arm cuff 12 includes a semi-spherical member that has a first end 14, a second end 16 and a perimeter wall 18 extending between the first 14 and second 16 ends. The first 14 and second 16 ends are open. The perimeter wall 18 has a break 20 therein extending through the first 14 and second 16 ends. The break 20 allows a diameter of the semi-spherical member to be selectively expanded. The perimeter wall 18 comprises a resiliently bendable material such as a plastic material. A strap 22 is coupled to the peripheral wall 18 and is removably extended across the break 20 to urge opposite edges 24 of the break 20 toward each other. More particularly, the strap 22 may have an attached end 26 attached to the perimeter wall 18 and a free end 28 which is extendable through a loop 30 attached to the perimeter wall 18 opposite the break 20 with respect to the attached end 26. Hook and loop securing members 32 attach the strap 22 to itself after the strap 22 is extended through the loop 30. An inner surface of the perimeter wall 18 may be covered with a resiliently compressible material 34.

A flexible hand engaging member 36 comprised of cloth, leather or an elastomer is positionable on a hand of the forward arm 70. The hand engaging member 36 has a first side 38, a second side 40, a forward edge 42, a rear edge 44, a first lateral edge 46 and a second lateral edge 48. The hand engaging member 36 has a thumb aperture 50 therein extending into the first side 38 and outwardly of the second side 40. The thumb aperture 50 is positioned adjacent to the forward edge 42 so that a thumb of the forward arm 70 is extendable through the thumb aperture 50 in such a position that it may abut the golf club 71. A plurality of couplers 52 engages and urges toward each other the first 46 and second 48 lateral edges. The couplers 52 and hand engaging member encircle a hand while a golf club 71 is being gripped. The couplers 52 include flexible tethers attached to either of the first 46 or second 48 lateral edges and coupled to the other one of the first 46 or second 48 lateral edges with hook and loop securing members 54.

An elongated rod 56 has a cuff end 58 and a hand end 60. The cuff end 58 is pivotally coupled to the arm cuff 12 and the hand end 60 is pivotally coupled to the first side 40 of the hand engaging member 36. The rod 56 is straight and maintains a distance between the arm cuff 12 and the hand engaging member 36. The hand end 60 is positioned between the thumb aperture 50 and the rear edge 44. The rod 56 is telescopic and has a selectively adjustable length. A locking member 61 retains the rod 56 in a selected length. The locking member 61 includes a threaded member 62 extendable through a first section 63 of the rod 56 and engageable with a second section 64 of the rod 56 to lock the first 63 and second 64 sections with respect to each other.

A cushion 65 is mounted on the second side 40 of the hand engaging member 36 opposite of the hand end 60 of the rod 56. The cushion 65 prevents the hand engaging member 36 from rubbing against and irritating the hand due to the pressure from the rod 56. A reinforcing pad 66 is attached to the first side 38 of the hand engaging member 36 and is positioned between the thumb aperture 50 and the first lateral edge 42. The reinforcing pad 66 may be comprised of a rubber, leather or plastic material to prevent the golf club 71 from wearing through the hand engaging member 36.

In use, the hand engaging member 36 and the arm cuff 12 are positionable on the forward arm 70. The rod 56 resists the bending of the forward arm 70 at the elbow during a golf swing. This will teach the golfer to keep their forward arm 70 straight during the golf swing to prevent the swing from collapsing as the golfer brings the golf club 71 above their head. The rod 56 will generally be positioned laterally or forward of the elbow to prevent the rod 56 from rubbing on the elbow. The length of the rod 56 may be adjusted to properly fit the length of the golfer's outer arm.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wearable golf swing teaching aid assembly being positionable on a forward arm of a person making a golf swing to resist bending of the forward arm, said assembly including:

an arm cuff being positionable on an upper portion of the forward arm;

a hand engaging member being positionable on a hand of the forward arm, said hand engaging member having a first side, a second side, a forward edge, a rear edge, a first lateral edge and a second lateral edge, a plurality of couplers engaging and urging toward each other said first and second lateral edges;

an elongated rod having a cuff end and a hand end, said cuff end being pivotally coupled to said arm cuff, said hand end being pivotally coupled to said first side of said hand engaging member, said rod being straight and maintaining a distance between said arm cuff and said hand engaging member;

a cushion being mounted on said second side of said hand engaging member opposite of said hand end of said rod; and wherein said hand engaging member and said arm cuff are positionable on the forward arm to resist bending of the forward arm during a golf swing.

2. The assembly according to claim 1, wherein said arm cuff includes:

a semi-spherical member having a first end, a second end and a perimeter wall extending between said first and second ends, said first and second ends being open, said perimeter wall having a break therein extending through said first and second ends, said break allowing a diameter of said semi-spherical member to be selectively expanded; and a strap being coupled to said peripheral wall and being removably extended across said break to urge opposite edges of said break toward each other.

3. The assembly according to claim 2, wherein said perimeter wall comprises a resiliently bendable material.

4. The assembly according to claim 1, wherein said hand engaging member has a thumb aperture therein extending into said first side and outwardly of said second side, said thumb aperture being positioned adjacent to said forward edge, a thumb of the forward arm being extendable through said thumb aperture.

5. The assembly according to claim 4, further including a reinforcing pad being attached to said first side of said hand engaging member and being positioned between said thumb aperture and said first lateral edge.

6. The assembly according to claim 1, wherein said rod is telescopic and has a selectively adjustable length, a locking member retains said rod in a selected length.

7. A wearable golf swing teaching aid assembly being positionable on a forward arm of a person making a golf swing to resist bending of the forward arm, said assembly including:

an arm cuff being positionable on an upper portion of the forward arm, said arm cuff including;

a semi-spherical member having a first end, a second end and a perimeter wall extending between said first and second ends, said first and second ends being open, said perimeter wall having a break therein extending through said first and second ends, said break allowing a diameter of said semi-spherical member to be selectively expanded, said perimeter wall comprising a resiliently bendable material;

a strap being coupled to said peripheral wall and being removably extended across said break to urge opposite edges of said break toward each other;

a hand engaging member being positionable on a hand of the forward arm, said hand engaging member having a first side, a second side, a forward edge, a rear edge, a first lateral edge and a second lateral edge, said hand engaging member having a thumb aperture therein extending into said first side and outwardly of said second side, said thumb aperture being positioned adjacent to said forward edge, a thumb of the forward arm being extendable through said thumb aperture, a plurality of couplers engaging and urging toward each other said first and second lateral edges;

an elongated rod having a cuff end and a hand end, said cuff end being pivotally coupled to said arm cuff, said hand end being pivotally coupled to said first side of said hand engaging member, said rod being straight and maintaining a distance between said arm cuff and said hand engaging member, said hand end being positioned between said thumb aperture and said rear edge, said rod being telescopic and having a selectively adjustable length, a locking member retaining said rod in a selected length;

a cushion being mounted on said second side of said hand engaging member opposite of said hand end of said rod;

a reinforcing pad being attached to said first side of said hand engaging member and being positioned between said thumb aperture and said first lateral edge; and wherein said hand engaging member and said arm cuff are positionable on the forward arm to resist bending of the forward arm during a golf swing.

8. A wearable golf swing teaching aid assembly being positionable on a forward arm of a person making a golf swing to resist bending of the forward arm, said assembly including:

an arm cuff being positionable on an upper portion of the forward arm;

a hand engaging member being positionable on a hand of the forward arm, said hand engaging member having a first side, a second side, a forward edge, a rear edge, a first lateral edge and a second lateral edge, a plurality of couplers engaging and urging toward each other said first and second lateral edges;

an elongated rod having a cuff end and a hand end, said cuff end being pivotally coupled to said arm cuff, said hand end being pivotally coupled to said first side of said hand engaging member, said rod being straight and maintaining a distance between said arm cuff and said hand engaging member;

said hand engaging member has a thumb aperture therein extending into said first side and outwardly of said second side, said thumb aperture being positioned adjacent to said forward edge, a thumb of the forward arm being extendable through said thumb aperture;

a reinforcing pad being attached to said first side of said hand engaging member and being positioned between said thumb aperture and said first lateral edge; and wherein said hand engaging member and said arm cuff are positionable on the forward arm to resist bending of the forward arm during a golf swing.

9. The assembly according to claim 8, wherein said arm cuff includes:

a semi-spherical member having a first end, a second end and a perimeter wall extending between said first and second ends, said first and second ends being open, said perimeter wall having a break therein extending through said first and second ends, said break allowing a diameter of said semi-spherical member to be selectively expanded; and a strap being coupled to said peripheral wall and being removably extended across said break to urge opposite edges of said break toward each other.

10. The assembly according to claim 9, wherein said perimeter wall comprises a resiliently bendable material.

11. The assembly according to claim 8, wherein said rod is telescopic and has a selectively adjustable length, a locking member retains said rod in a selected length.

* * * * *